US010393118B2

(12) United States Patent
Lehmann et al.

(10) Patent No.: US 10,393,118 B2
(45) Date of Patent: Aug. 27, 2019

(54) SCREW MACHINE

(71) Applicant: MAN DIESEL & TURBO SE, Augsburg (DE)

(72) Inventors: Tim Lehmann, Gelsenkirchen (DE); Norbert Tewes, Dinslaken (DE); Jürgen Wennemar, Haltern am See (DE)

(73) Assignee: MAN Energy Solutions SE, Augsburg (DE)

( * ) Notice: Subject to any disclaimer, the term of this patent is extended or adjusted under 35 U.S.C. 154(b) by 109 days.

(21) Appl. No.: 15/148,392

(22) Filed: May 6, 2016

(65) Prior Publication Data

US 2016/0327043 A1 Nov. 10, 2016

(30) Foreign Application Priority Data

May 9, 2015 (DE) ..... 10 2015 006 129

(51) Int. Cl.
*F04C 18/16* (2006.01)
*F04C 28/12* (2006.01)

(52) U.S. Cl.
CPC ..... *F04C 18/16* (2013.01); *F04C 28/12* (2013.01)

(58) Field of Classification Search
CPC ..... F04C 18/16; F04C 28/12
See application file for complete search history.

(56) References Cited

U.S. PATENT DOCUMENTS 3,314,597 A * 4/1967 Schibbye ..... F01C 1/16 418/159
4,005,949 A * 2/1977 Grant ..... F04C 28/125 418/15
6,082,985 A 7/2000 Suzuki et al.
6,898,948 B2 5/2005 Roelke et al.
2005/0013702 A1* 1/2005 Dieterich ..... F04C 18/16 417/313
2006/0008375 A1 1/2006 Hasegawa
(Continued)

FOREIGN PATENT DOCUMENTS

CN 1492150 4/2004
CN 1720397 1/2006
CN 2040992000 U 1/2015
(Continued)

OTHER PUBLICATIONS

Search Report dated Sep. 7, 2016 which issued in the corresponding Great Britain Patent Application No. 1607298.5.
(Continued)

*Primary Examiner* — Audrey K Bradley
*Assistant Examiner* — Anthony Ayala Delgado
(74) *Attorney, Agent, or Firm* — Cozen O'Connor

(57) ABSTRACT

A screw machine having a rotor housing portion and an outflow housing portion, screw rotors mounted in the rotor housing portion that form a rotor pair, and a control slide that is likewise mounted in the rotor housing portion, which delimits a working space of the rotor housing portion and which can be shifted parallel to the rotor axes of the screw rotors to change a size of the effective working space. The control slide, when shifted out of the rotor housing portion into the outflow housing portion, is guided by a positively joined guide of the outflow housing portion.

10 Claims, 3 Drawing Sheets

(56) References Cited

U.S. PATENT DOCUMENTS

2017/0211574 A1* 7/2017 Loerch ..... F04C 28/12

FOREIGN PATENT DOCUMENTS

| | | |
|---|---|---|
| DE | 1293384 | 4/1969 |
| DE | 153417 | 1/1981 |
| DE | 69815005 | 1/2004 |
| DE | 10242139 | 3/2004 |
| DE | 103 26 466 | 1/2005 |
| EP | 0902188 | 3/1999 |
| GB | 959831 | 6/1964 |
| JP | 57-195890 | 12/1982 |
| JP | S 6017957 B2 | 5/1985 |
| JP | 2001-304157 | 10/2001 |

OTHER PUBLICATIONS

Search Report dated Jun. 9, 2016 which issued in the corresponding German Patent Application No. 10 2015 006 129.1.

* cited by examiner

SCREW MACHINE

BACKGROUND OF THE INVENTION

1. Field of the Invention

The invention relates to a screw machine, in particular a screw compressor.

2. Description of the Related Art

The fundamental construction of screw machines designed for example as screw compressors is familiar to the person skilled in the art. Accordingly, a screw compressor comprises a machine housing or a compressor housing, which comprises a rotor housing portion and an outflow housing portion. In the rotor housing portion, screw rotors are mounted that form a rotor pair and serve for compressing a medium to compressed. Likewise, a control slide is mounted in the rotor housing portion, which in portions delimits a working space or a compression space of the rotor housing portion and for changing the size of the effective working space or effective compression space is shiftable parallel to the rotor axes of the screw rotors.

Accordingly, a screw compressor is known from DE 103 26 466 A1 with screw rotors mounted in a working space or compression space, wherein the working space is delimited in portions by a control slide, which can be shifted out of the rotor housing into the region of the outflow housing in order to define or adjust the effective working space or effective compression space. Here, the effective working space or effective compression space is the smaller the further the control slide is shifted out of the rotor housing into the outflow housing.

With screw compressors known from practice the control slide is guided in the rotor housing portion. When the effective working space of the screw compressors is to be reduced in size, the control slide is shifted out of the rotor housing portion into the outflow housing portion, wherein the effectiveness of the guide of the control slide in the rotor housing portion is dependent on the shifting path. The further the control slide is shifted into the outflow housing portion, the less the control slide is guided in the rotor housing portion. This can result in the control slide, at its end projecting into the outflow housing portion, shifting so that it collides with the screw rotors. Because of this, the screw compressor can be damaged.

SUMMARY OF THE INVENTION

There is a need for a screw machine, in particular a screw compressor, which avoids the above disadvantages. An object of the present invention is based on creating a new type of screw machine.

According to one aspect of the invention, the control slide, when shifting out of the rotor housing portion, into the outflow housing portion is guided through a positively joined guide of the outflow housing portion.

According to one aspect of the invention, the control slide, when shifting out of the rotor housing portion into the outflow housing portion, is not only guided on the rotor housing side but additionally also on the outflow housing side, namely by way of a positively joined guide of the outflow housing portion for the control slide. In particular when the control slide is shifted far out of the rotor housing portion into the outflow housing portion a shifting of the control slide, which would result in a collision of the same with the screw rotors, can be safely and reliably prevented.

According to an advantageous further development, the positively joined guide of the outflow housing portion comprises a guide rod that supports and guides the control slide in a positively joined manner when the same is shifted out of the rotor housing portion into the outflow housing portion, wherein the control slide at an end facing the outflow housing portion or the guide rod comprises a recess that the guide rod enters at least in particular when the same is shifted out of the rotor housing portion into the outflow housing portion. Here, the guide rod and the recess of the control slide each extend parallel to the rotor axes of the screw rotors. This configuration of the positively joined guide of the control slide on the outflow housing portion is simple and reliable in design.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are obtained from the subclaims and the following description. Exemplary embodiments of the invention are explained in more detail with the help of the drawing without being restricted to this. The drawings show:

FIG. 1: is a cross section through a screw machine configured as screw compressor in a first position of the control slide image it is maximally shifted into the rotor housing portion;

DETAILED DESCRIPTION OF THE PRESENTLY PREFERRED EMBODIMENTS

The present invention relates to a screw machine, in particular a screw compressor.

Figure 4:
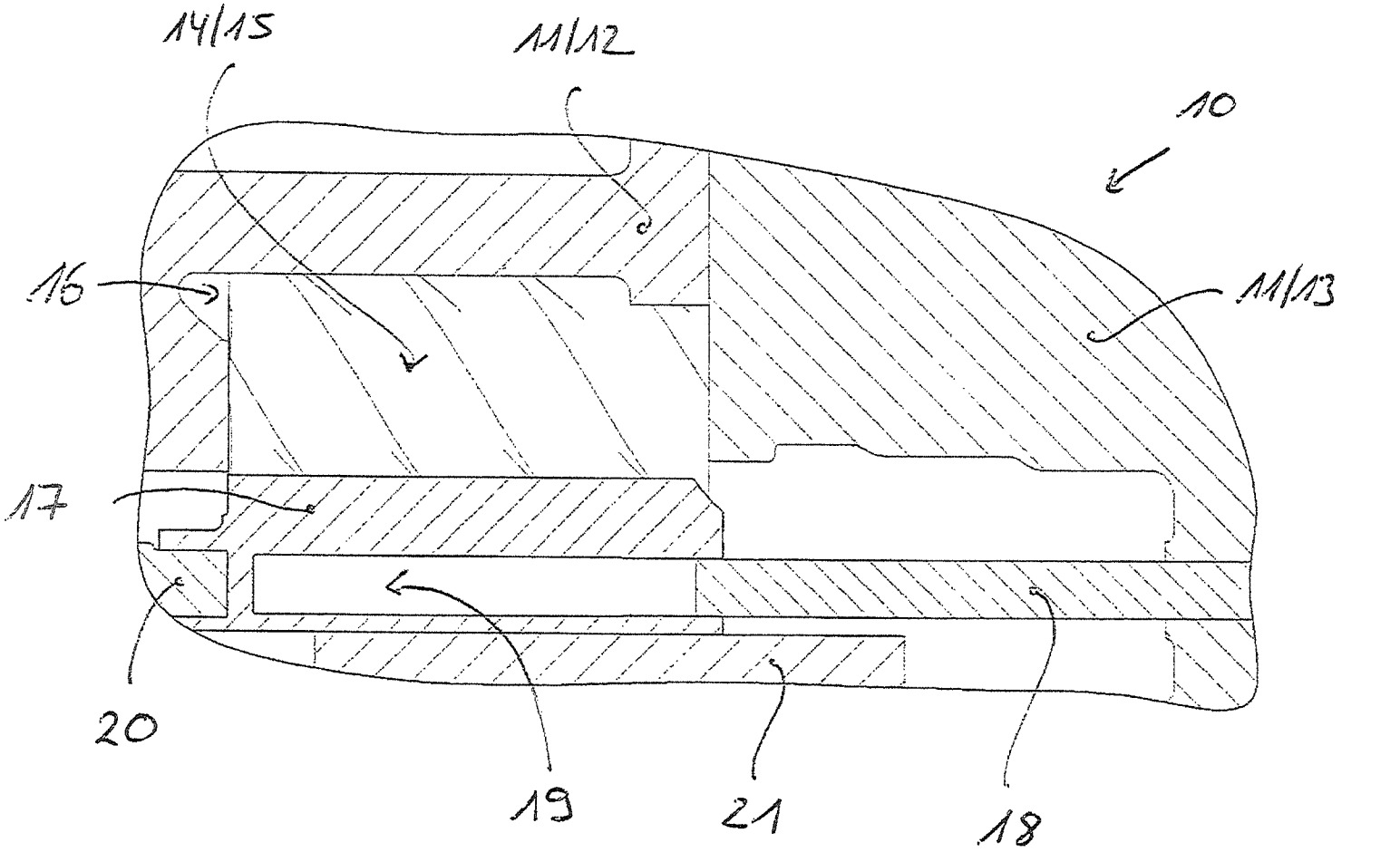
Figure 2:
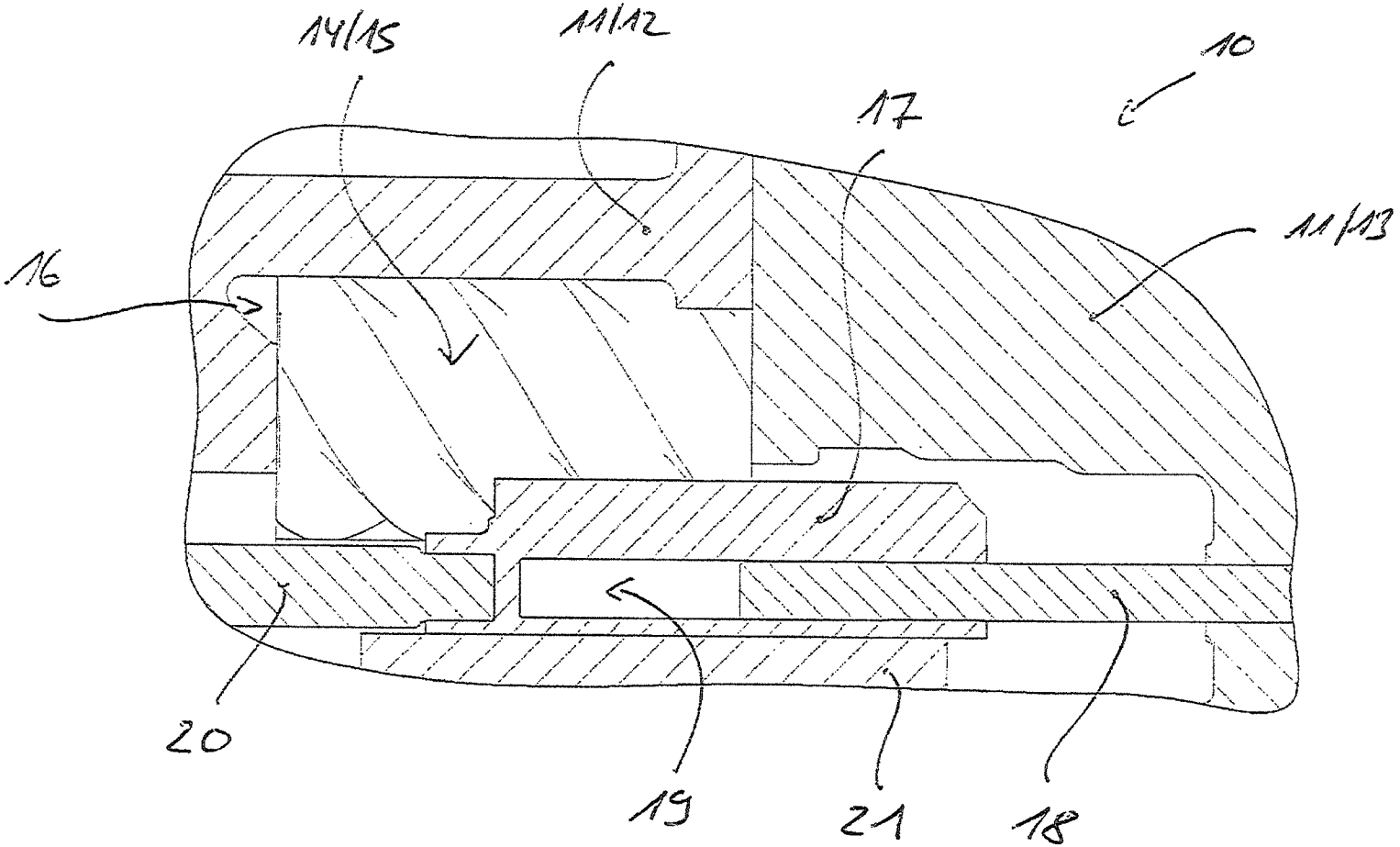
FIG. 2: is a cross section through the screw compressor of FIG. 1 in a second position of the control slide.
Figure 3:
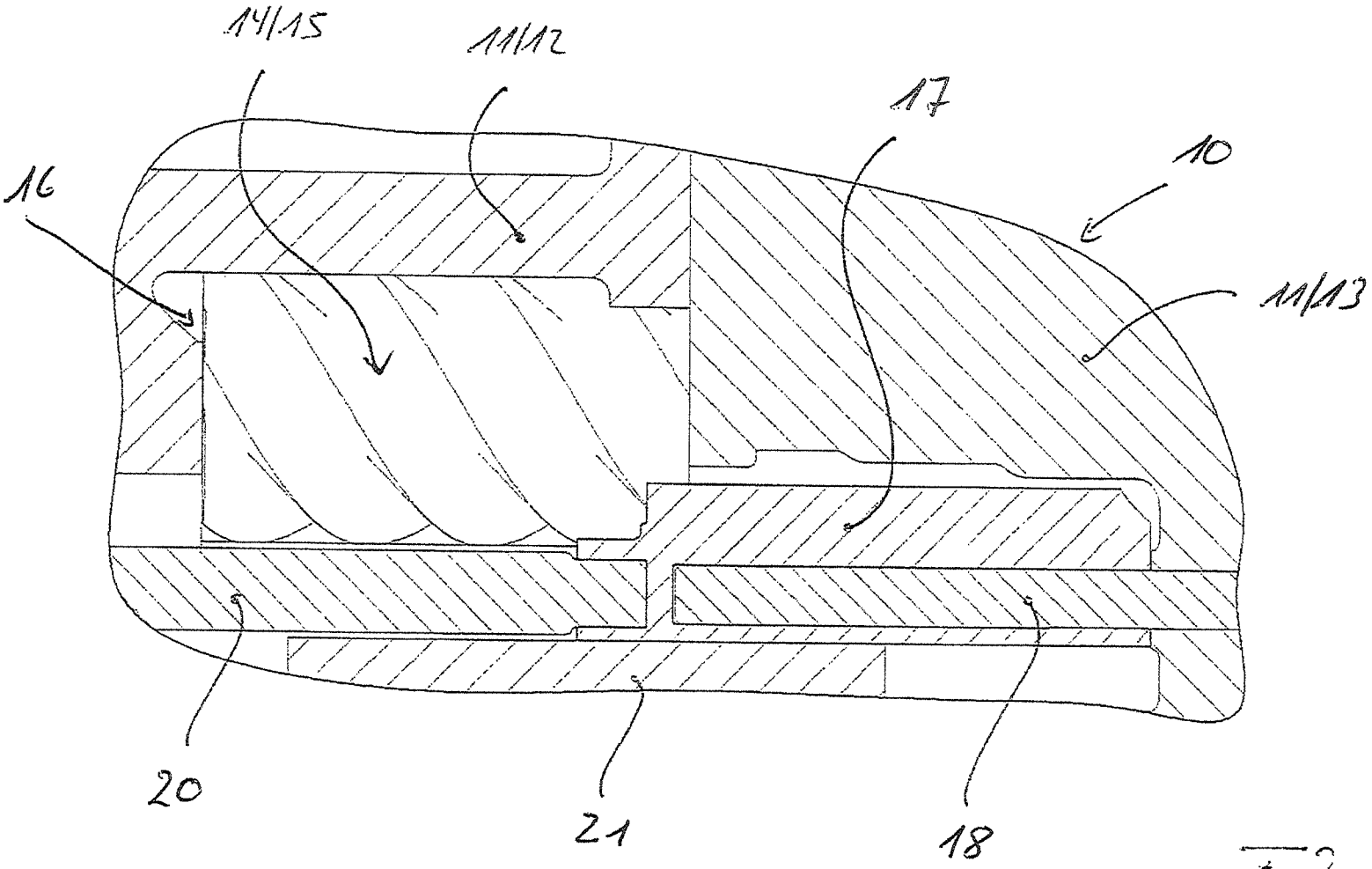
FIG. 3: is a cross section through the screw compressor of FIGS. 1 and 2 in a third position of the control slide in which it is maximally shifted out of the rotor housing portion.

FIG. 1 to 3 each show cross section through a screw machine which is embodied as a screw compressor 10. The screw compressor 10 comprises a compressor housing 11, which comprises a rotor housing portion 12 and an outflow housing portion 13. The compressor housing 11, consisting of the rotor housing portion 12 and the outflow housing portion 13, which can be designed both in one part and also in multiple parts.

The screw compressor 10 furthermore comprises screw rotors 14, 15, rotatably mounted in the rotor housing portion 12 of the screw compressor 10 that form a pair of screw rotors 14, 15.

The rotor housing portion 12 together with a control slide 17 mounted in the rotor housing portion 12 defines a working space or compression space 16, in which a medium to be compressed is compressed by the screw rotors 14, 15. In the Figures, the control slide 17 defines the working space or compression space in portions at the bottom, wherein the control slide 17 for changing the size of the effective working space or for changing the size of the effective compression space can alternatively be shifted parallel to rotor axes of the screw rotors 14, 15.

In particular when, as shown in FIG. 1, the control slide 17 is maximally shifted into the rotor housing portion 12, the effective working space or effective compression space 16 is maximal. For reducing the effective compression space 16 in size, the control slide 17 can be shifted out of the position shown in FIG. 1, namely out of the rotor housing portion 12 into the outflow housing portion 13, wherein FIG. 2 shows a relative position of the control slide 17, in which the effective compression space is reduced compared with FIG. 1. The further the control slide 17 is shifted out of the rotor housing portion 12 into the outflow housing portion 13, the smaller is the effective compression space 16 of the screw compressor 10. In particular when, as shown in FIG. 3, the control slide 17 is maximally shifted out of the rotor housing portion 12, the effective working space or effective compression space 16 is minimal.

As already explained, the control slide 17 is guided in the rotor housing portion 12, in particular via a guide 21, which acts on the control slide 17 at the bottom. The further the control slide 17 is shifted out of the rotor housing portion 12, the less effective is this guide 21 and the guide bore in the rotor housing portion 12. According to one aspect of the invention, the control slide 17 when shifted out of the rotor housing portion 12 into the outflow housing portion 13 is therefore guided by a positively joined guide of the outflow housing portion 13.

In the shown preferred exemplary embodiment, this positively joined guide of the outflow housing portion 13 is formed by a preferentially cylindrical guide rod 18, that supports and guides the control slide 17 in a positively joined manner when the same is shifted out of the rotor housing portion 12 into the outflow housing portion 13.

Here, this guide rod 18 interacts with a preferentially cylindrical recess 19 introduced on an end of the control slide 17 facing the outflow housing portion 13 or the guide rod 18 into the same, wherein the guide rod 18 at least projects into this recess 19 or enters this recess 19 in particular when the control slide 17 is shifted at least in portions out of the rotor housing portion 12 into the outflow housing portion 13.

It is possible that when the control slide 17 is completely or maximally shifted into the rotor housing portion 12 the guide rod 18 does not project into the recess 19 of the control slide 17. In this case, the guide rod 18 enters the recess 19 of the control slide 17 only when the control slide 17 has already been shifted by a defined dimension out of the rotor housing portion 12 into the outflow housing portion 13. In this case it can be provided that the guide rod 18 becomes effective and projects into the recess 19 of the control slide 17 in particular when the guide 21 and/or the guide bore of the rotor housing portion 12 is or are no longer fully effective.

It is also possible that the guide rod 18 partly projects into the recess 19 of the control slide 17 in particular when the control slide 17 has been completely or maximally shifted into the rotor housing portion 12 (see FIG. 1). This embodiment is preferred since the guide rod 18 need not be threaded into the recess 19 of the control slide 17 when the control slide 17 is shifted out of the position shown in FIG. 1.

As already explained, the recess 19 in the control slide 17, into which the guide rod 18 projects, is formed on an end of the control slide 17 facing the outflow housing portion 13 or the guide rod 18 and extends parallel to the rotor axes of the screw rotors 14, 15 into the control slide 17. A device 20, via which the control slide 17 can be linearly shifted parallel to the rotor axes of the screw rotors 14, 15 for changing the effective compression space 16 acts on the opposite end of the control slide 17.

The guide rod 18 acts on the outflow housing portion 13 with an end facing away from the bearing housing portion 12 and thus from the control slide 17, wherein the opposite end of the same, dependent on the relative position of the control slide 17, projects into the recess 19 of the control slide 17 by a varying distance.

There is no risk that as a consequence of forces acting on the control slide 17 that result from the pressure conditions on the control slide 17 that the control slide 17 can shift and collide with the screw rotors 14, 15. Flapping or oscillating of the control slide 17 can also be effectively minimised.

The screw machine shown in FIG. 1 to 3 is a screw compressor, into which oil is injected for cooling and lubrication. However, the invention is not restricted to the use with such an oil-injected screw compressor, the invention can also be employed also with oil-free screw compressors or other screw machines such as screw motors, screw pumps and the like.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A screw machine, comprising a machine housing having a rotor housing portion and an outflow housing portion;

screw rotors mounted in the rotor housing portion that form a rotor pair;

a control slide mounted in the rotor housing portion that delimits a compression space of the rotor housing portion and configured to be shifted parallel to a rotor axis of the screw rotors to changing a size of an effective working space such that the effective working space is made smaller as the control slide is shifted out of the rotor housing portion into the outflow housing portion;

a control device coupled to a first end of the control slide and configured to linearly shift the control slide; and a positively joined stationary guide configured to directly slidingly guide the control slide at a second end of the control slide, opposite the first end of the control slide, as the control slide is shifted out of the rotor housing portion into the outflow housing portion, wherein the stationary guide has a first end affixed to the outflow housing portion and a second end configured to mate with the second end of the control slide and facing.

2. The screw machine according to claim 1, wherein the positively joined stationary guide of the outflow housing portion comprises a guide rod that supports and guides the control slide in a positively joined manner.

3. The screw machine according to claim 2, wherein the guide rod extends parallel to the rotor axis of the screw rotors.

4. The screw machine according to claim 2, wherein the guide rod is configured to support and guide the control slide in a positively joined manner when the control slide is shifted out of the rotor housing portion into the outflow housing portion.

5. The screw machine according claim 1, wherein the screw machine is a screw compressor.

6. The screw machine according to claim 2, wherein the control slide comprises a recess which the guide rod enters on an end of the control slide facing at least one of the outflow housing portion and the guide rod.

7. The screw machine according to claim 6, wherein the guide rod enters the recess of the control slide when the control slide has been at least partly shifted out of the rotor housing portion into the outflow housing portion.

8. The screw machine according to claim 6, wherein the guide rod enters the recess of the control slide in portions with a portion facing at least one of the rotor housing portion and the control slide when the control slide has been maximally shifted into the rotor housing portion.

9. The screw machine according to claim 6, wherein the recess of the control slide extends parallel to the rotor axis of the screw rotors.

10. The screw machine according to claim 6, wherein the recess of the control is open towards the outflow housing portion.

* * * * *